US010151117B2

(12) United States Patent
Kuelker

(10) Patent No.: US 10,151,117 B2
(45) Date of Patent: Dec. 11, 2018

(54) HANGER FOR PRECAST CLADDING PANELS, AND PRECAST PANEL INCORPORATING SAME

(71) Applicant: Peter Kuelker, Calgary (CA)

(72) Inventor: Peter Kuelker, Calgary (CA)

( * ) Notice: Subject to any disclaimer, the term of this patent is extended or adjusted under 35 U.S.C. 154(b) by 0 days.

(21) Appl. No.: 15/849,893

(22) Filed: Dec. 21, 2017

(65) Prior Publication Data

US 2018/0171621 A1 Jun. 21, 2018

Related U.S. Application Data

(60) Provisional application No. 62/437,346, filed on Dec. 21, 2016.

(51) Int. Cl.

| | |
|---|---|
| ***E04F 13/08*** | (2006.01) |
| ***E04B 1/41*** | (2006.01) |
| ***E04F 13/072*** | (2006.01) |
| ***E04B 2/58*** | (2006.01) |
| ***E04F 13/07*** | (2006.01) |
| *B28B 23/00* | (2006.01) |
| *E04B 2/02* | (2006.01) |
| *E04F 13/00* | (2006.01) |

(52) U.S. Cl.

CPC ..... *E04F 13/0801* (2013.01); *E04B 1/41* (2013.01); *E04B 2/58* (2013.01); *E04F 13/07* (2013.01); *E04F 13/072* (2013.01); *E04F 13/0835* (2013.01); *E04F 13/0851* (2013.01); *B28B 23/005* (2013.01); *E04B 2002/0258* (2013.01); *E04F 13/007* (2013.01); *E04F 13/0894* (2013.01)

(58) Field of Classification Search

CPC .. E04B 2/56; E04B 2/58; E04F 13/072; E04F 13/07; E04F 13/08; E04F 13/0801; E04F 13/0805; E04F 13/0803; E04F 13/0835; E04F 13/14; E04F 13/007; E04F 13/0851

See application file for complete search history.

(56) References Cited

U.S. PATENT DOCUMENTS 2,293,744 A * 8/1942 Miles ..... E04F 13/007 52/543
5,311,714 A * 5/1994 Passeno ..... E04F 13/0801 52/314

(Continued)

*Primary Examiner* — Adriana Figueroa
*Assistant Examiner* — Jessie T Fonseca
(74) *Attorney, Agent, or Firm* — Donald V. Tomkins

(57) ABSTRACT

An elongate hanger for precast cladding panels includes an anchorage band embeddable in an upper region of a precast panel; an abutment band contiguous with the anchorage band and providing an abutment surface for the lower edge of an upper panel in a panel assembly mounted to a support wall; a ventilation band contiguous with and extending horizontally from the abutment band, and having one or more ventilation openings; and a mounting band contiguous with and extending upward from the ventilation band in a tilted off-vertical plane when the panel is mounted to a support wall by fasteners extending through a lower region of the mounting band. The hanger vertically supports the cladding panel at a distance from the support wall corresponding to an air space defined by the selected hanger geometry, with the ventilation openings facilitating the flow of water or water vapor out of the air space.

14 Claims, 5 Drawing Sheets

(56) References Cited

U.S. PATENT DOCUMENTS

| | | | | |
|---|---|---|---|---|
| 5,398,473 | A * | 3/1995 | Chan | E04F 13/0812 52/235 |
| 5,673,529 | A * | 10/1997 | Treister | E04C 2/288 52/235 |
| 9,316,004 | B1 * | 4/2016 | Hatzinikolas | F16M 13/02 |
| 9,856,655 | B2 * | 1/2018 | Knight | E04F 13/0862 |
| 9,869,097 | B2 * | 1/2018 | Fernandez | E04F 13/0805 |
| 2003/0150179 | A1 * | 8/2003 | Moreno | E04F 13/0808 52/235 |
| 2010/0011700 | A1 * | 1/2010 | Grant | E04F 13/0864 52/748.11 |
| 2010/0146893 | A1 * | 6/2010 | Dickinson | E04B 1/70 52/302.3 |
| 2011/0061337 | A1 * | 3/2011 | O'Shea | E04F 13/0808 52/747.12 |
| 2012/0104202 | A1 * | 5/2012 | Lukaszewicz | E04F 13/083 248/223.41 |
| 2013/0167465 | A1 * | 7/2013 | Santeramo | E04B 9/10 52/506.07 |
| 2016/0230793 | A1 * | 8/2016 | Gulnick | E04F 13/0801 |
| 2017/0284104 | A1 * | 10/2017 | Hatzinikolas | E04F 13/0801 |

* cited by examiner

HANGER FOR PRECAST CLADDING PANELS, AND PRECAST PANEL INCORPORATING SAME

FIELD OF THE DISCLOSURE

The present disclosure relates in general to precast cladding panels, and in particular to hangers cast into precast cladding panels to facilitate mounting of the panels on a supporting structure.

BACKGROUND

Precast panels of various sizes and shapes are widely used as cladding on building walls, serving as components of building envelope systems intended to prevent infiltration of rain and outside air into the building. Precast cladding panels are commonly made of concrete, but may also be made with other cast materials known in the construction field. Concrete cladding panels are common on large structures such as office buildings, but they are also used on residential housing structures as an alternative to traditional cladding materials such as wood siding and brick.

Whether installed on large or small buildings, it is desirable for cladding panels to be mounted in such a way that there will be a continuous air space between the rear (i.e., inner) faces of the panels and the supporting structure, while at the same time providing reliable structural support for the panels, both to transfer the vertical weight of the panels to the supporting structure and to provide anchorage against lateral forces (such as wind) that may act on the panels.

The purpose of the air space is to provide a passage through which any water or moisture vapour that gets behind the cladding can be directed away from the building envelope before it infiltrates other parts of the building. Although caulking or other sealant materials are typically used to seal the spaces between cladding panels, the possibility of moisture infiltration behind the cladding—as a result of vapour migration, direct penetration of rainwater (due to sealant deterioration or other factors), or leakage at roof-to-wall junctures—cannot be entirely eliminated. If such moisture is not removed from the building envelope fairly promptly, it will tend to migrate further into the building, potentially causing a variety of problems that could entail costly maintenance and repairs and could detract from the building's overall durability and value. Such problems may include drywall damage due to moisture absorption, rot and mold in wooden construction components (e.g., studs and sheathing), corrosion of non-rust-resistant construction hardware, and staining on interior building finishes.

When an air space is provided behind the cladding, moisture can run downward behind the cladding to exit points such as weepholes built into the cladding system at appropriate locations. The air space also facilitates or enhances air circulation behind the cladding, helping to remove moisture vapour before it can condense inside the wall structure, and helping to dry out any wall structure components that may have become damp due to moisture infiltration.

One of the challenges facing designers of cladding panel support systems is to provide hangers or brackets that can adequately support weight of the panels at a distance away from the face of the supporting structure (i.e., so as to provide the desired air space), without significantly impeding the passage of water or water vapour through the air space. In this regard, it is particularly desirable to avoid or minimize hanger-to-panel connection details where moisture might become trapped or which might impede the downward vertical flow of moisture along the back of the panel. Depending on design preferences and panel manufacturing process constraints, hangers for precast cladding panels can be mechanically mounted to the panels after the panels have cured (such as by means of bolts, or by field-welding to mounting plates embedded in the panels), or they can be embedded into the panels during the panel-casting process.

It is desirable for precast cladding panels to be stackable as compactly as possible to minimize space requirements during storage and shipping. Accordingly, it is desirable for precast cladding panels to be configured such that they can be stacked in a way that minimizes or substantially eliminates space between stacked cladding panels, thus minimizing storage space requirements.

For the foregoing reasons, there is a need for improved precast cladding panel systems and hanger systems that enable secure mounting of panels at a uniform distance away from a vertical supporting structure without introducing significant impediments to air flow and moisture flow through the air space thus created between the panels and the supporting structure. In addition, there is a need for improved cladding panel hangers that can be embedded in precast panels during the casting process and which, although protruding from the finished panels, do not significantly impede the ability to stack the panels with minimal if any space between adjacent panels in the stack. The present disclosure is directed to these needs.

BRIEF SUMMARY

The present disclosure teaches embodiments of a hanger adapted to be cast into a precast cladding panel and which facilitates mounting of the panel onto a wall or other supporting structure without need for additional mounting hardware except for fasteners such as screws or nails. The hanger is configured such that an air space will be created between the precast cladding and the supporting structure, with air circulation through the air space being facilitated by openings formed in the hanger.

Accordingly, in a first aspect the present disclosure teaches an elongate hanger for embedment in a precast cladding panel, wherein the hanger defines:

- a mounting band having an upper longitudinal edge plus a lower longitudinal edge parallel to the upper longitudinal edge;
- a ventilation band having a first longitudinal edge coincident with the lower longitudinal edge of the mounting band, plus a second longitudinal edge parallel to first longitudinal edge of the ventilation band, wherein ventilation band defines a plurality of ventilation openings, and wherein the ventilation band forms a first angle with the mounting band, such that the ventilation band extends generally outward in a first horizontal direction from the lower longitudinal edge of the mounting band;
- an abutment band having an upper longitudinal edge coincident with the second longitudinal edge of the ventilation band, plus a lower longitudinal edge parallel to the upper longitudinal edge of the abutment band, wherein the abutment band forms a second angle with the ventilation band, such that the abutment band extends downward from the second longitudinal edge of the ventilation band; and
- an anchorage band having an upper longitudinal edge coincident with the lower longitudinal edge of the abutment band, wherein the anchorage band forms a third angle with the abutment band, such that the anchorage band extends both downward and outward in the first horizontal direction from the lower longitudinal edge of the abutment band.

The first, second, and third angles may be obtuse angles.

The mounting band may have a plurality of fastener holes in a lower region of the mounting band. In preferred embodiments, the center-to-center spacing of adjacent fastener holes will not be greater than 1.50 inches, and in particularly preferred embodiments will be approximately 1.25 inches.

The anchorage band preferably defines a plurality of anchorage openings, which may be of any configuration including but not limited to rectangular and triangular. The anchorage band also may include corrugated portions.

The abutment band may incorporate one or more bendable tabs.

The mounting band may be provided with one or more holes for facilitating mounting of the hanger in formwork for a precast panel.

In a second aspect, the present disclosure teaches a precast panel having an inner face, an outer face, a top edge face, and a bottom edge face, and further having a hanger as described above, with its anchorage band embedded in an upper portion of the panel such that:

- an external face the abutment band of the hanger is coplanar with the inner face of the panel, and an upper portion of the abutment band extends above the top edge face of the panel;
- the ventilation band of the panel extends horizontally away from the inner face of the panel; and
- the mounting band extends upward from the ventilation band at an obtuse angle relative to the ventilation band.

BRIEF DESCRIPTION OF THE DRAWINGS

Embodiments in accordance with the present disclosure will now be described with reference to the accompanying Figures, in which numerical references denote like parts, and in which.

DETAILED DESCRIPTION

Figure 1:
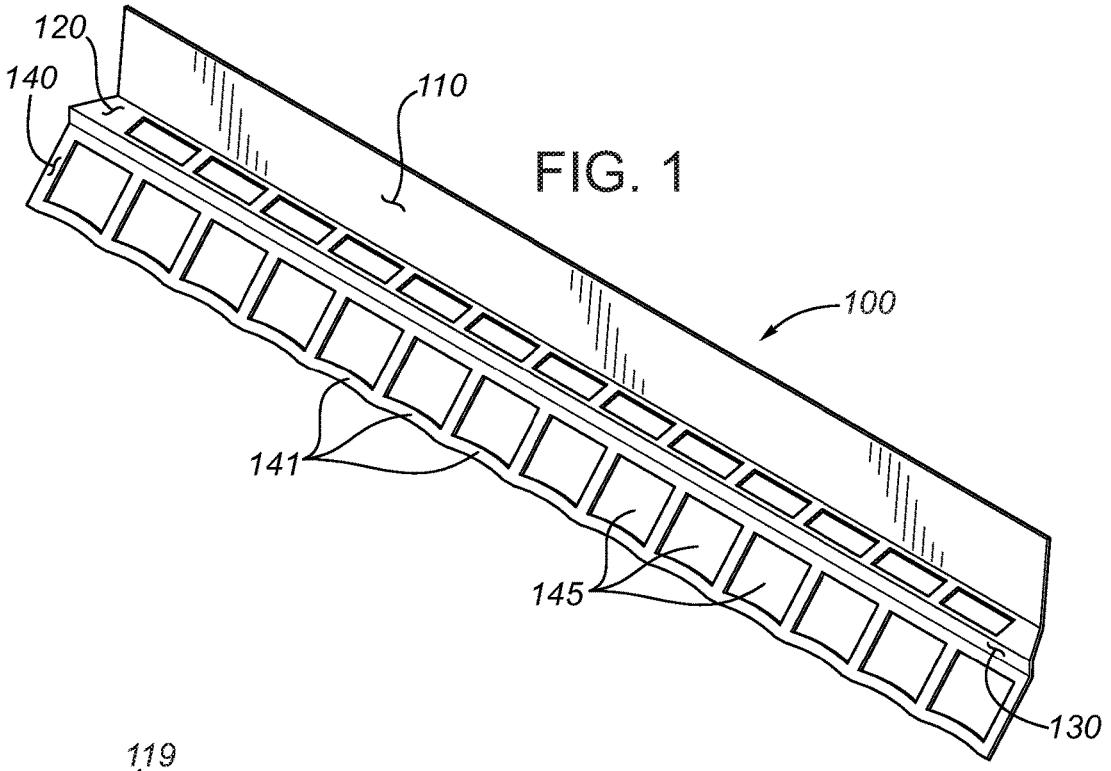
FIG. 1 is an isometric view of a first embodiment of a panel hanger in accordance with the present disclosure.
Figure 2:
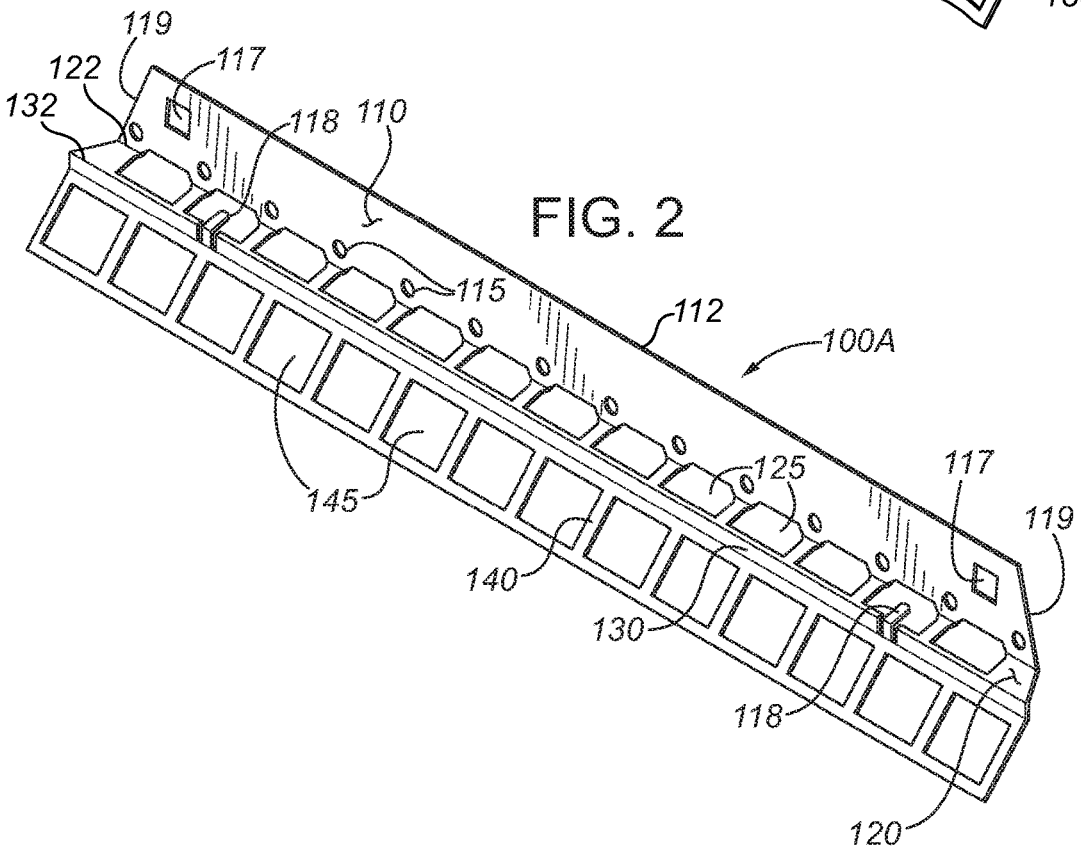
FIG. 2 is an isometric view of a first variant of the panel hanger in FIG. 1.

FIG. 1 illustrates a first embodiment 100 of a hanger for embedment into a precast cladding panel to facilitate mounting of the panel to a supporting structure. FIG. 2 illustrates a variant 100A of hanger 100 that is essentially the same as hanger 100 but with additional features; accordingly, the following description of hanger 100A is also applicable to hanger 100 except for additional features specific to hanger 100A.

Figure 4A:
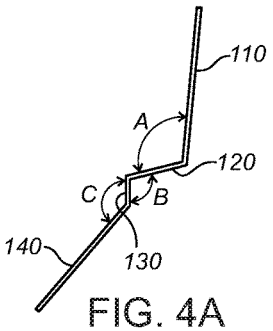
FIG. 4A is a free-body diagram of the hanger shown in FIG. 4, indicating angles formed between adjacent panel sections.

As shown in FIG. 2, hanger 100A is an elongate member having a generally uniform cross-sectional profile. As best appreciated with additional reference to FIGS. 4 and 4A, hanger 100A defines four contiguous and generally planar segments or bands, as follows:

- a top (or "mounting") band 110 having an upper longitudinal edge 112 and a lower longitudinal edge 114 parallel to upper longitudinal edge 112, plus a plurality of fastener holes 115 at selected intervals for receiving suitable fasteners F (such as, by way of non-limiting example, wood screws or lag bolts);
- an upper intermediate (or "ventilation") band 120 having a first longitudinal edge 122 coincident with lower longitudinal edge 114 of mounting band 110, plus a second longitudinal edge 124 parallel to first longitudinal edge 122, wherein ventilation band 120 defines a plurality of ventilation openings 125, and may (but not necessarily must) form an obtuse angle A with mounting band 110;
- a lower intermediate (or "abutment") band 130 having an upper longitudinal edge 132 coincident with second longitudinal edge 124 of ventilation band 120, plus a lower longitudinal edge 134 preferably (but not necessarily) parallel to upper longitudinal edge 132, with abutment band 130 preferably (but not necessarily) forming an obtuse angle B with ventilation band 120, with angle B being larger than angle A; and
- a bottom (or "anchorage") band 140 having an upper longitudinal edge 142 coincident with lower longitudinal edge 134 of abutment band 130, plus a lower longitudinal edge 144 preferably (but not necessarily) parallel to upper longitudinal edge 142, wherein anchorage band 140 defines a plurality of anchorage openings 145 (for enhanced embedment in fluid concrete), and preferably (but not necessarily) forms an obtuse angle C with abutment band 130.

Figure 5:
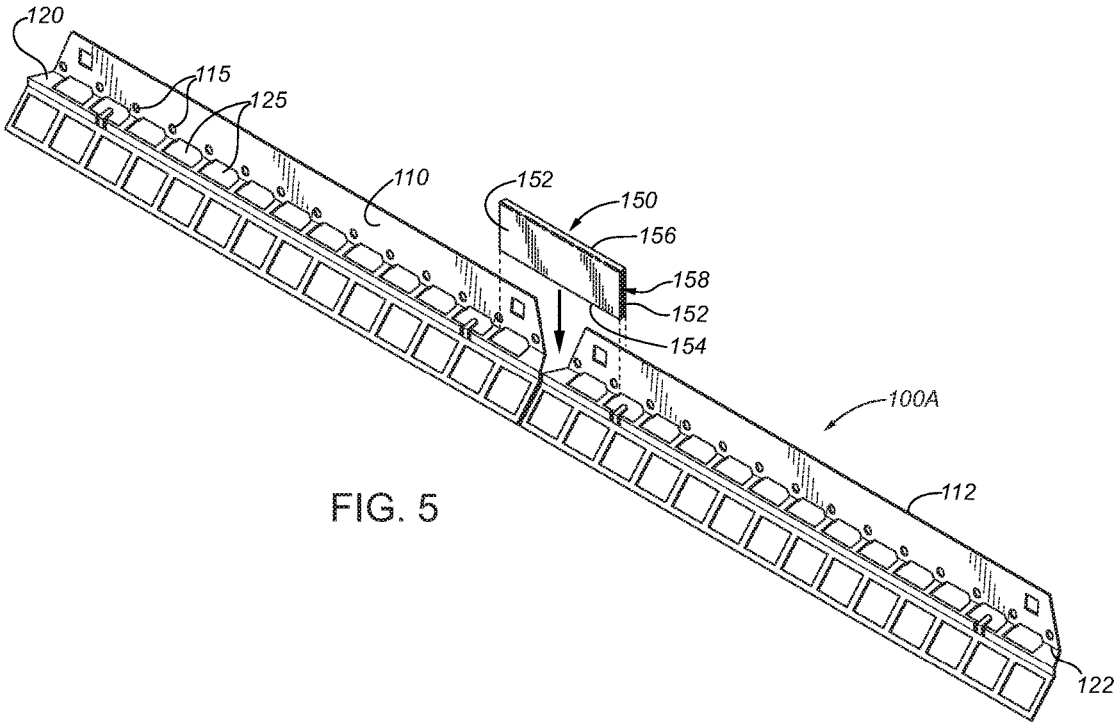
FIG. 5 is an isometric view of a hanger connection clip for mounting onto laterally-adjacent panel hangers.
Figure 6:
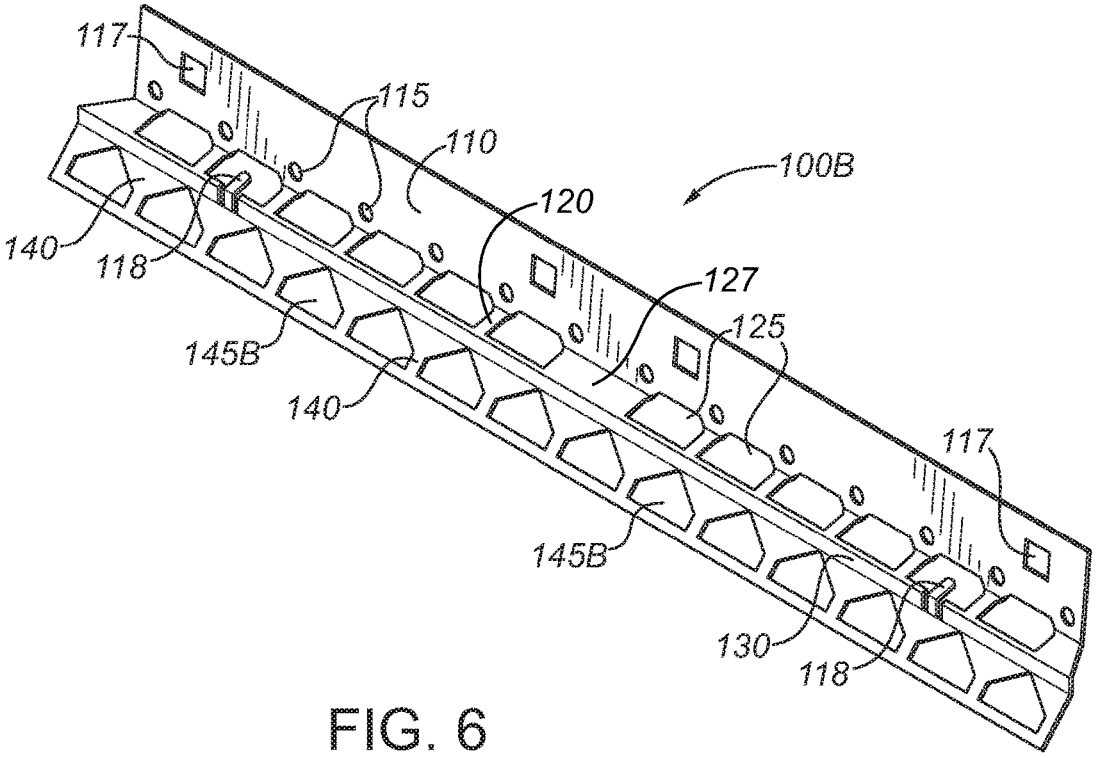
FIG. 6 is an isometric view of a second variant of the panel hanger in FIG. 1.

As shown in FIGS. 2, 5, and 6, ventilation openings 125 in ventilation band 120 optionally may extend partially into a lower region of mounting band 110, to increase the total open area available for passage of air and water vapour.

Fastener holes 115 in mounting band 110 may be spaced as necessary or desired to suit the requirements of particular cladding panel installations. In one embodiment particularly suitable for mounting cladding panels to supporting walls framed with vertical wood studs, fastener holes 115 may be spaced at regular intervals of 1.25 inches (or less). Because standard wood studs are 1.50 inches thick, a fastener hole spacing of 1.25 inches ensures that there will always be a fastener hole 115 available at each stud, regardless of the stud spacing.

As indicated by reference numbers 119 in FIG. 2, the ends of mounting band 110 optionally may be bevelled at a desired angle (e.g., 45 degrees) so that hangers 100 can be installed around building corners without the hangers on each side of the corner interfering with each other or requiring field trimming (e.g., for quirk joints).

In preferred embodiments, anchorage band 140 defines a plurality of openings 145 to enhance the effectiveness of its anchorage into a precast panel, by allowing the fluid panel material (e.g., concrete or liquid stone) to flow through openings 145 during the casting process and thus create a mechanical interlock between anchorage band 140 and the cured panel material. Optionally (and as best seen in FIG. 1 with reference to hanger 100), anchorage band 140 may have corrugations 141 to further enhance anchorage effectiveness, and to facilitate "nestable" stacking and bundling of the hangers for shipping and storage prior to being embedded in precast panels.

As shown in FIG. 2, variant hanger 100A has the additional optional feature of holes 117 at desired locations in mounting band 110, for use in supporting and keeping hanger 100A in place in panel formwork during vibration of fluid panel material (e.g., concrete) during the panel-casting process. For example, holes 117 could be used to support hanger 100A on hooks provided on or built into the formwork.

Figure 4:
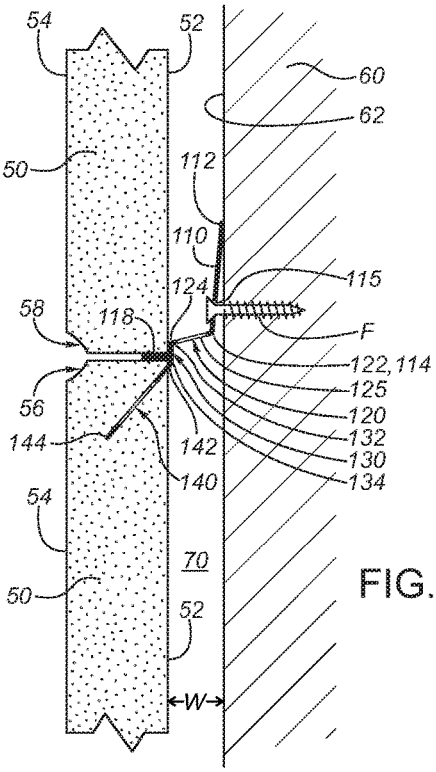
FIG. 4 is an enlarged cross-sectional detail at a typical horizontal joint in a cladding panel assembly as in FIG. 3.

Another optional feature of hanger 100A is the provision of one or more bendable tabs 118 formed into abutment band 130. In their initial configuration, tabs 118 are oriented into the plane of ventilation band 120 (as shown in FIGS. 2, 5, and 6), for ease of fabrication of hanger 100A and so as not to impede compact hanger stacking. However, when panels incorporating hangers 100A are being mounted onto a supporting structure, tabs 118 can be bent outward if necessary or desired so as to be disposed within the horizontal joint between two vertically-adjacent panels, and thus to provide supplemental structural support for the upper of the two adjacent panels (as shown in FIG. 4). Tabs 118 also may act as shims to form a uniform horizontal gap between horizontal rows of panels.

Figure 3:
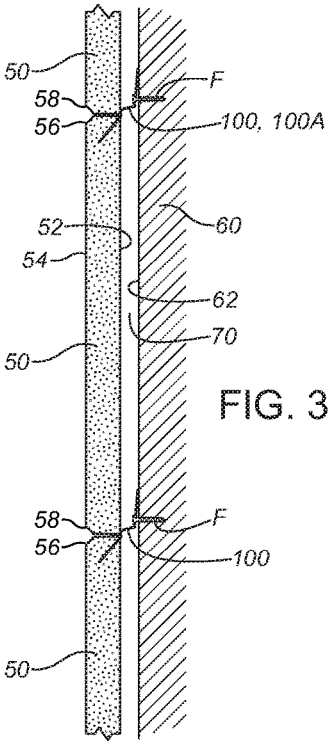
FIG. 3 is a vertical cross-section through an exterior wall assembly incorporating precast cladding panels having panel hangers as in FIG. 1 or FIG. 2.

FIGS. 3 and 4 depict an assembly of precast concrete panels 50 mounted to a vertical support structure 60 by means of hangers 100 (or 100A) embedded in panels 50. FIG. 4 illustrates the configuration of hanger 100 (or 100A) in greater detail, and further illustrates how it is embedded into panel 50 and how it may be used to mount panel 50 to support structure 60.

As shown in FIGS. 3 and 4, a typical cladding panel 50 has an inner face 52, an outer face 54, a top edge 56, and a bottom edge 58. As shown in FIG. 4, hanger 100 is cast into panel 50 such that an external face of abutment band 130 of hanger 100 is coplanar with inner face 52 of panel 50, and with an upper portion of abutment band 130 extending above top edge 56 of panel 50 so as to act as an abutment for a lower portion of inner face 52 of the overlying panel 50, thereby facilitating the installation of panels 50 in uniformly vertical alignment without need for spacers or other means for maintaining a uniform space between the inner faces 52 of panels 50 and the outer face 62 of support structure 60. Mounting band 110 and ventilation band 120 of hanger 100, in combination, thus effectively serve as spacing means for keeping inner faces 52 of panels 50 at a uniform lateral distance (i.e., corresponding to the width W of air space 70) from outer face 62 of support structure 60.

As shown in FIG. 4, when a cladding panel 50 is mounted to support structure 60 using hanger 100, mounting band 110 preferably lies in a tilted plane at a selected angle off the vertical (i.e., with upper longitudinal edge 112 of mounting band 110 being farther from inner face 52 of panel 50 than lower longitudinal edge 114 of mounting band 110), such that only upper longitudinal edge 112 of mounting band 110 comes into contact with support structure 60. The tilted plane of mounting band 110 promotes drainage of moisture away from support structure 60.

Ventilation band 120, which is contiguous with mounting band 110, preferably will have a generally horizontal orientation when panel 50 is mounted to a vertical support structure 60 (such as a wall), and in preferred embodiments may have a downward tilt away from mounting band 110 so as to promote drainage of any condensation in air space 70 away from support structure 60 and toward the mounted assembly of panels 50.

A typical procedure for installing panels 50 having hangers 100 may be readily understood with reference to FIGS. 3 and 4. The lowermost horizontal row of panels 50 may be set on a suitable ledger or other support means attached to or incorporated into the building structure in accordance with known techniques. Fasteners F are then installed through fastener holes 115 in mounting bands 110 of hangers 100 to anchor the upper portions of panels 50 both vertically and laterally to support structure 60. When panels 50 are thus mounted, upper longitudinal edges 112 of mounting bands 110 will be the only parts of hangers 100 in contact with outer face 62 of support structure 60. The next horizontal row of panels 50 is then installed in the same fashion, with their lower edges preferably resting on temporary or permanent shims to create a continuous horizontal gap between the adjacent horizontal rows of panels, and laterally abutting upper portions of the abutment bands 130 of the hangers 100 of the panels 50 below.

Provided that hangers 100 have suitable structural strength and stiffness, the installation of fasteners F into support structure 60 will have the beneficial effect of urging the lower portions of the corresponding panels 50 inward toward support structure 60) and into lateral contact with abutment bands 130 of the hangers 100 below (as discussed above). This happens because the lateral forces acting on mounting band 110 (due to the installation of fasteners F) will induce a counter-clockwise moment (as viewed in FIG. 4) about a horizontal contact line between upper longitudinal edges 112 of mounting bands 110 and outer face 62 of support structure 60.

In addition to facilitating the inducement of a beneficial moment about upper longitudinal edges 112 of mounting bands 110 as described above, the fact that mounting bands 110 lie in a tilted plane extending downward and away from support structure 60 makes it possible to adjust the lateral position of the upper edges of panels 50 relative to support structure 60 by tightening or loosening fasteners F as necessary.

FIG. 4 also illustrates how tabs 118 of variant hangar 100A may be deployed to extend into the horizontal joint between two vertically-adjacent panels 50.

Exterior wood-framed walls are typically covered with plywood or other exterior sheathing, but in some cases exterior wood-framed walls may be left unsheathed. As well, although exterior wood-framed walls commonly have wood studs (or other vertical framing elements) at a maximum horizontal spacing of 16 inches, in some cases the studs may be spaced up to or more than 24 inches apart. Panel hangers 100 in accordance with the present disclosure can be adapted for mounting precast panels to virtually any sheathed stud wall regardless of the width of the panels.

However, a problem can arise in the case of unsheathed stud walls where the width of some or all of the cladding panels is less than the clear space between studs, since the length of hanger 100 for a given precast panel will typically correspond to approximately the width of that panel. In such cases, the situation may arise where a panel's width and its position in the cladding assembly are such that the panel does not overlap any stud, such that there is no stud available for installing a fastener F to mount the panel. Another situation that may arise is where the a panel overlaps only a single stud and can therefore be mounted with only a single fastener F, resulting in the panel being "wobbly" (which would typically be unsatisfactory).

As illustrated in FIG. 5, such situations can be dealt with by installing hanger connection clips 150 (of functionally suitable length) over the mounting bands 110 of horizontally-adjacent hangers 100 (or 100A), to provide an element of structural continuity between adjacent hangers mounted onto an unsheathed wall. This will make it possible to mount cladding panels that are smaller in width than the clear space between the wall studs, and to stabilize panels that can be anchored to only a single stud.

Clip 150 may be of any functionally-effective configuration, but in the illustrated embodiment it is essentially a folded plate having a "hairpin" (i.e., U-shaped) cross-sectional profile, comprising a pair of side plates 152 extending between an upper folded edge 156 and lower edges 154, and defining a gap 158 between side plates 152. Preferably, the width of gap 158 will closely correspond to the thickness of mounting bands 110 of hangers 100 onto which clip 150 is to be mounted, and may in fact be slightly less than the mounting band thickness so that clip 150 will be retained on mounting bands 110 by a friction fit, or by a clamping effect induced by elastic bending of clip 150 as gap 158 is forced to widen to receive mounting bands 110 (i.e., if the thickness of mounting bands 110 is greater than gap 158). Alternatively or in addition, clip 150 may be connected to mounting bands 110 using sheet metal screws or other suitable fasteners to enhance structural continuity between the panel hangers 100 (or 100A) to which clip 150 is mounted.

The dimensions of clip 150 may be selected to suit the requirements of specific panel installations and the dimensions of specific panel hangers 100 (or 100A).

FIG. 6 illustrates a variant panel hanger 100B that is generally similar to hanger 100A in FIG. 2, except that ventilation band 120 of hanger 100B has one or more larger solid sections 127 between ventilation openings 125, to facilitate cutting hanger 110B into two (or more) pieces, and anchorage band 140 of hanger 100B has triangular openings 145B instead of rectangular openings 145 as in hanger 100A. It has been found that the use of triangular openings in anchorage band 140 can significantly increase the structural strength of the hanger compared to hangers having rectangular openings.

Figure 7:
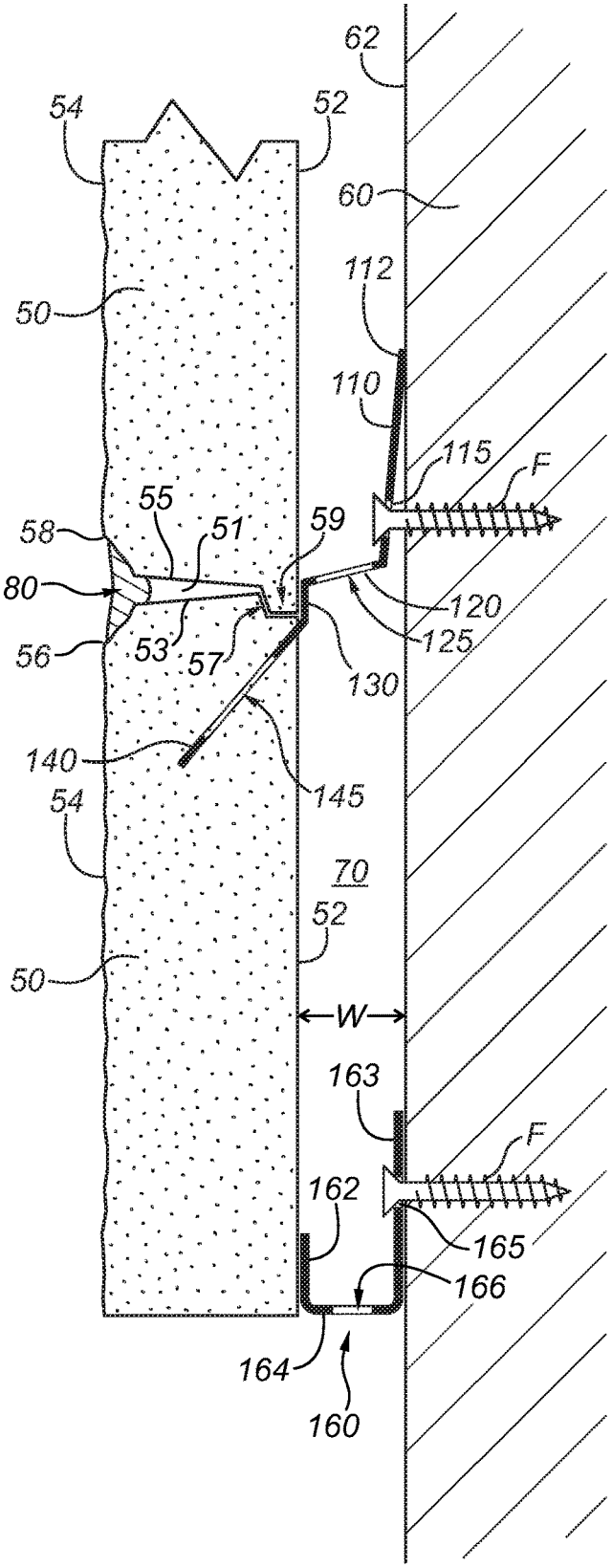
FIG. 7 is a cross-section through a lower region of an exterior wall assembly incorporating precast cladding panels having panel hangers in accordance with the present disclosure.

FIG. 7 illustrates a J-channel 160 that may be used at the bottom of a cladding panel 50 that is mounted to a support structure 60 without another panel 50 or other support element below it. J-channel 160 has a first vertical upstand 162 contiguous with a horizontal web member 164, which in turn is contiguous with a second vertical upstand 163. The width of of J-channel 160 (i.e., between the outer faces of upstands 162 and 163) will correspond to width W or air space 70 in the mounted panel assembly. Horizontal web member 164 preferably has drainage holes 166 to allow moisture to drain out of air space 70. Second upstand 163 has fastener holes 165 for mounting J-channel 160 to support structure 60 using suitable fasteners F. First upstand 162 acts as an abutment for the bottom of panel 50. The previously-noted counter-clockwise moment induced in panel 50 by the installation of fasteners F in the hanger at the top of panel 50 tends to urge the lower part of panel 50 against first upstand 162 of J-channel 160, thus keeping panel 50 in vertical alignment with the panels 50 above. Optionally, a mastic or adhesive of suitable type may be applied to the outer face of first upstand 162 prior to mounting of the corresponding panel 50 on support structure 60, to provide resistance to wind forces tending to pull panel 50 away from J-channel 160 and thus out of vertical alignment.

FIG. 7 also illustrates alternative details for the upper and lower edges 56 and 58 (respectively) of precast cladding panel 50. Whereas the panel 50 shown in FIGS. 3 and 4 has squared-off upper and lower edges 56 and 58, upper and lower edges 56 and 58 of panel 50 in FIG. 7 have bevelled edge faces 53 and 55 (respectively) that will form an outwardly-opening V-groove 51 at horizontal joints between vertically-adjacent mounted panels. V-groove 51 optionally may receive a bead of mastic 80 to deter entry of wind-driven rain into air space 70. A downwardly-extending lip 59 is formed at the bottom of rear face 52 of panel 50, with lip 59 being receivable in a mating groove 57 formed at the top of rear face 52 of panel 50. As may be seen in FIG. 7, lip 59 can act as an abutment for abutment band 130 of panel hanger 100.

Panel hangers 100, 100A, and 100B (and hanger clips 150) in accordance with the present disclosure may be fabricated from metal plate or sheet metal of appropriate thickness and structural properties to suit expected service conditions for a given installation. The material used for hangers 100, 100A, and 100B (and hanger clips 150) could be galvanized steel or another corrosion-resistant metal. However, the material used to fabricate hangers in accordance with the present disclosure is not restricted to metallic materials, and in alternative embodiments could be fabricated from a suitable plastic material. Hangers 100, 100A, and 100B preferably will be of unitary construction, but this is not essential; in alternative embodiments the hangers could be made up from multiple components or pieces joined together by suitable means.

Although hangers 100A and 100B are shown as having fastener holes 115 in mounting band 110, this is not essential to all embodiments of hangers within the scope of the present disclosure. Alternative embodiments could be fabricated without fastener holes in the mounting band (such as in hanger 100 in FIG. 1), with the intention being that fastener holes could be drilled or punched subsequent to initial hanger fabrication, in the field or elsewhere. Alternatively, the mounting band could be anchored to a supporting structure using self-drilling or self-tapping screws driven through the mounting band without need for pilot holes.

It will be readily appreciated by those skilled in the art that various modifications to embodiments in accordance with the present disclosure may be devised without departing from the present teachings, including modifications that may use structures or materials later conceived or developed. It is to be especially understood that the scope of the present disclosure and claims should not be limited to or by any particular embodiments described, illustrated, and/or claimed herein, but should be given the broadest interpretation consistent with the disclosure as a whole. It is also to be understood that the substitution of a variant of a described or claimed element or feature, without any substantial resultant change in functionality, will not constitute a departure from the scope of the disclosure or claims.

In this patent document, any form of the word "comprise" is intended to be understood in a non-limiting sense, meaning that any element or feature following such word is included, but elements or features not specifically mentioned are not excluded. A reference to an element or feature by the indefinite article "a" does not exclude the possibility that more than one such element or feature is present, unless the context clearly requires that there be one and only one such element or feature. Any use of any form of any term describing an interaction between recited elements is not meant to limit the interaction to direct interaction between the elements in question, but may also extend to indirect interaction between the elements such as through secondary or intermediary structure.

Relational terms such as but not limited to "vertical", "horizontal", "parallel", "uniform", "planar", and "coplanar", are not intended to denote or require absolute mathematical or geometrical precision. Accordingly, such terms are to be understood as denoting or requiring substantial precision only (e.g., "substantially horizontal" or "generally parallel") unless the context clearly requires otherwise. Any use of any form of the term "typical" is to be interpreted in the sense of being representative of common usage or practice, and is not to be interpreted as implying essentiality or invariability.

What is claimed is:

1. An elongate hanger for embedment in a precast cladding panel, wherein said hanger defines:

(a) a mounting band having an upper longitudinal edge plus a lower longitudinal edge parallel to the upper longitudinal edge;

(b) a ventilation band having a first longitudinal edge coincident with the lower longitudinal edge of the mounting band, plus a second longitudinal edge parallel to first longitudinal edge of the ventilation band, wherein ventilation band defines a plurality of ventilation openings, and wherein the ventilation band forms a first angle with the mounting band, such that the ventilation band extends generally outward in a first horizontal direction from the lower longitudinal edge of the mounting band, said first angle being an obtuse angle;

(c) an abutment band having an upper longitudinal edge coincident with the second longitudinal edge of the ventilation band, plus a lower longitudinal edge parallel to the upper longitudinal edge of the abutment band, wherein the abutment band forms a second angle with the ventilation band, such that the abutment band extends downward from the second longitudinal edge of the ventilation band, and wherein said second angle is smaller than the first angle; and (d) an anchorage band having an upper longitudinal edge coincident with the lower longitudinal edge of the abutment band, wherein the anchorage band forms a third angle with the abutment band, such that the anchorage band extends both downward and outward in the first horizontal direction from the lower longitudinal edge of the abutment band.

2. A hanger as in claim 1 wherein the second angle is an obtuse angle.

3. A hanger as in claim 1 wherein the mounting band has a plurality of fastener holes in a lower region of the mounting band.

4. A hanger as in claim 3 wherein the horizontal spacing between adjacent fastener holes of the plurality of fastener holes is not greater than 1.50 inches.

5. A hanger as in claim 4 wherein the horizontal spacing between adjacent fastener holes of the plurality of fastener holes is approximately 1.25 inches.

6. A hanger as in claim 1 wherein one or more of the ventilation openings in the ventilation band extend into a lower region of the mounting band.

7. A hanger as in claim 1 wherein the anchorage band defines a plurality of anchorage openings.

8. A hanger as in claim 7 wherein one or more of the anchorage openings in the anchorage band have a generally triangular configuration.

9. A hanger as in claim 1 wherein the anchorage band includes corrugated portions.

10. A hanger as in claim 1 wherein the abutment band incorporates one or more bendable tabs.

11. A hanger as in claim 1 wherein the mounting band is provided with one or more holes for facilitating mounting of the hanger in formwork for a precast panel.

12. An assembly of two hangers as in claim 1, wherein the two hangers are in linearly adjacent alignment, with a generally U-shaped hanger clip mounted over adjacent portions of the mounting bands of the two hangers so as to interconnect the two hangers and to provide structural continuity therebetween, said hanger clip comprising a pair of side plates separated by a gap having a width closely corresponding to the thickness of the mounting bands.

13. A precast panel having an inner face, an outer face, a top edge face, and a bottom edge face, and further having a hanger as in claim 1 with the anchorage band of the hanger being embedded in an upper portion of the panel such that:

(a) an external face of the abutment band of the hanger is coplanar with the inner face of the panel, and an upper portion of the abutment band extends above the top edge face of the panel;

(b) the ventilation band of the hanger extends horizontally away from the inner face of the panel; and (c) the mounting band of the hanger extends upward from the first longitudinal edge of the ventilation band so as to lie in a tilted plane relative to the inner face of the panel, with the upper longitudinal edge of the mounting band being farther away from the inner face of the panel than the lower longitudinal edge of the mounting band.

14. A precast panel as in claim 13 wherein the top and bottom edge faces of the panel are beveled so as to form an outwardly-opening V-groove at horizontal joints between vertically-adjacent mounted panels.

* * * * *